US009925563B2

(12) United States Patent
Bartl et al.

(10) Patent No.: US 9,925,563 B2
(45) Date of Patent: Mar. 27, 2018

(54) VIBRATION EXCITER FOR STEERABLE SOIL COMPACTING DEVICES

(71) Applicant: Wacker Neuson Produktion GmbH & Co. KG, Munich (DE)

(72) Inventors: Andreas Bartl, Worth (DE); Martin Simon, Taufkirchen (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 0 days.

(21) Appl. No.: 14/655,469

(22) PCT Filed: Nov. 14, 2013

(86) PCT No.: PCT/EP2013/003433
§ 371 (c)(1),
(2) Date: Jun. 25, 2015

(87) PCT Pub. No.: WO2014/101976
PCT Pub. Date: Jul. 3, 2014

(65) Prior Publication Data

US 2015/0352595 A1 Dec. 10, 2015

(30) Foreign Application Priority Data

Dec. 27, 2012 (DE) ..... 10 2012 025 376

(51) Int. Cl.
*E01C 19/38* (2006.01)
*E02D 3/074* (2006.01)
(Continued)

(52) U.S. Cl.
CPC ..... *B06B 1/166* (2013.01); *E01C 19/38* (2013.01); *E02D 3/046* (2013.01); *E02D 3/074* (2013.01); *Y10T 74/18344* (2015.01)

(58) Field of Classification Search
CPC ..... E02D 3/074; E01C 19/38; E01C 19/41; B06B 1/16; H02K 7/061
(Continued)

(56) References Cited

U.S. PATENT DOCUMENTS 3,871,788 A 3/1975 Barsby
5,010,778 A * 4/1991 Riedl ..... B06B 1/164 366/128
(Continued)

FOREIGN PATENT DOCUMENTS

DE 2827124 A1 * 1/1980 ..... E02D 3/074
DE 32 34 380 A1 3/1984
(Continued)

OTHER PUBLICATIONS

Machine Translation of German Patent Document DE 101 05 687 A1.*
U.S. Appl. No. 14/655,451, filed Jun. 25, 2015.

*Primary Examiner* — William Kelleher
*Assistant Examiner* — Bobby Rushing, Jr.
(74) *Attorney, Agent, or Firm* — Boyle Fredrickson, S.C.

(57) ABSTRACT

A vibration exciter for a soil compacting device, comprising a first unbalanced shaft, a second unbalanced shaft, which is arranged axially parallel to the first unbalanced shaft and which is contra-directionally rotatably coupled to the first unbalanced shaft in a form-locked manner, and a drive device for rotatably driving one of the two unbalanced shafts. The second unbalanced shaft has a first unbalanced shaft half and a second unbalanced shaft half, which is arranged coaxially to the first unbalanced shaft half and which can rotate relative to the first unbalanced shaft half. At least one respective unbalanced mass is arranged on the first unbalanced shaft, on the first unbalanced shaft half, and on the second unbalanced shaft.

10 Claims, 1 Drawing Sheet

(51) Int. Cl.
*B06B 1/16* (2006.01)
*E02D 3/046* (2006.01)

(58) Field of Classification Search
USPC ..... 74/61, 87; 404/133.05, 133.1
See application file for complete search history.

(56) References Cited

U.S. PATENT DOCUMENTS 5,818,135 A * 10/1998 Riedl ..... B06B 1/166
173/49
7,165,469 B2 * 1/2007 Niemi ..... B06B 1/166
404/133.05
7,302,871 B2 * 12/2007 Laugwitz ..... B06B 1/16
172/41
7,520,963 B2 * 4/2009 Honkanen ..... D21F 1/20
162/256

FOREIGN PATENT DOCUMENTS

DE 100 38 206 A1 2/2002
DE 101 05 687 A1 10/2002
DE 10 2010 010 037 A1 9/2011
DE 102014105023 A1 * 10/2014 ..... E01C 19/38

* cited by examiner

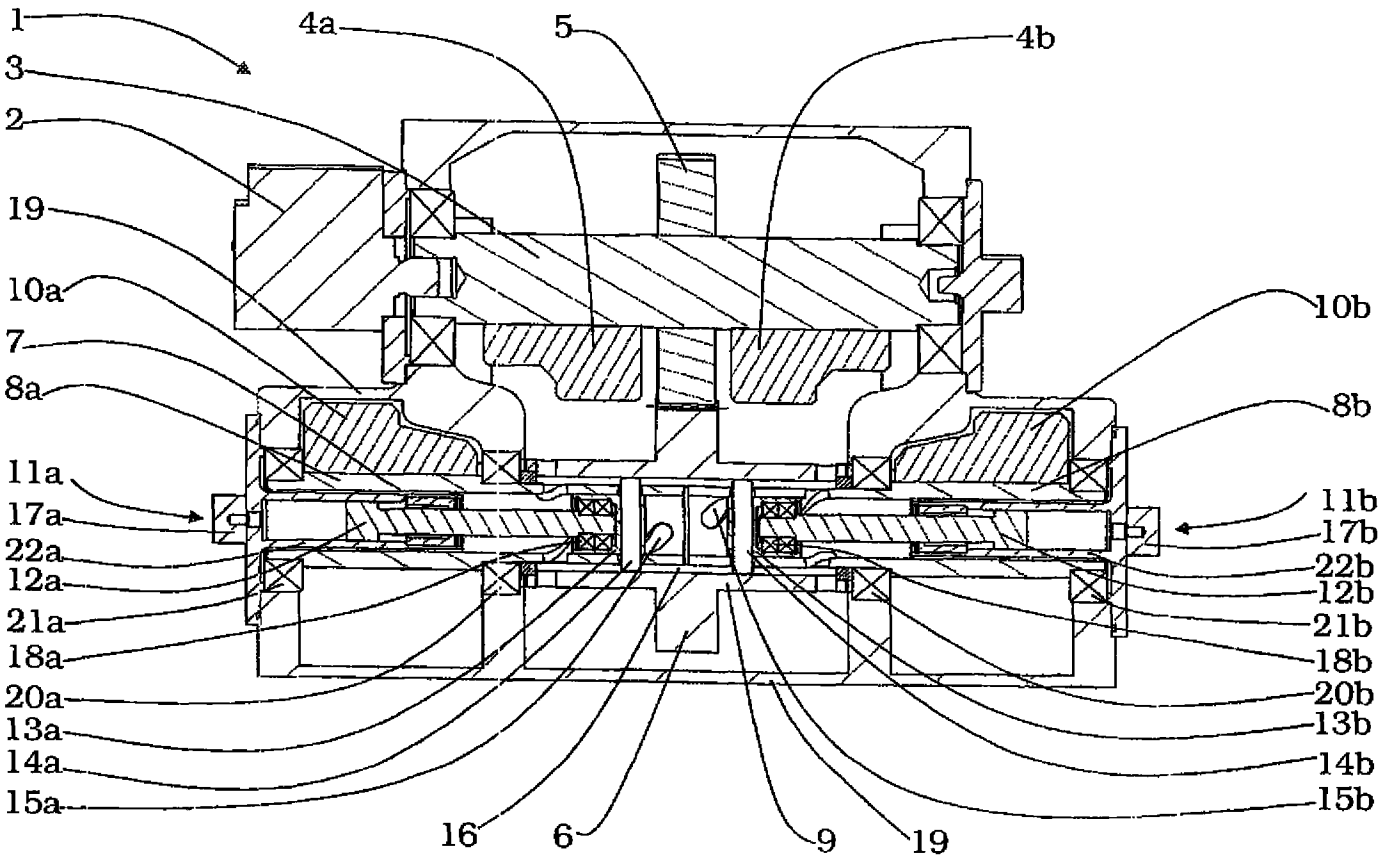
1
3
2
19
10a
7
8a
11a
17a
22a
12a
21a
18a
20a
13a
14a
15a
4a
5
4b
10b
8b
11b
17b
22b
12b
21b
18b
20b
13b
14b
15b
16
6
9
19

VIBRATION EXCITER FOR STEERABLE SOIL COMPACTING DEVICES

BACKGROUND OF THE INVENTION

1. Field of the Invention

The invention relates to a vibration exciter for a ground compaction device.

2. Discussion of the Related Art

Steerable ground compaction devices or vibratory plates for use in the construction industry have long been known. For example, G 78 18 542.9 and DE 101 05 687 A1 present steerable ground compaction devices wherein a vibration exciter is arranged in a housing on a ground contact plate.

SUMMARY OF THE INVENTION

The presented vibration exciters have two imbalance shafts which are coupled so as to be rotatable in opposite directions and which have imbalance masses formed thereon, the phase angle of which relative to one another is adjustable. By means of an adjustment of the phase angle, the direction of action of a resultant force vector generated by the rotating imbalance masses can be varied such that the ground compaction device moves in a forward or reverse direction.

Furthermore, on one of the imbalance shafts, two imbalance masses which are rotatable relative to the imbalance shaft are arranged with an axial offset to one another. The positions of each of the two imbalance masses with respect to the imbalance shaft that bears them are individually adjustable, such that, in interaction with the opposite, further imbalance shaft, resultant force vectors can be attained which generate a yaw moment about a vertical axis of the ground compaction device. In this way, a rotation of the ground compaction device, and thus steering, are made possible without the need for further external forces to be exerted, for example by an operator, on the ground compaction device.

The invention is based on the object of specifying a vibration exciter which, while being of robust design, achieves a high level of rotational dynamics and thus improves the traveling behavior of the ground compaction device.

The object is achieved according to the invention by providing a vibration exciter for a ground compaction device that has a first imbalance shaft, a second imbalance shaft which is arranged axially parallel to the first imbalance shaft and which is coupled to the first imbalance shaft in positively locking fashion so as to rotate in the opposite direction, and a drive device for driving one of the imbalance shafts in rotation, wherein the second imbalance shaft has a first imbalance shaft half and a second imbalance shaft half, which is arranged coaxially with respect to the first imbalance shaft half and which is rotatable relative to the first imbalance shaft half, and wherein in each case at least one imbalance mass is arranged or formed on and/or fastened to the first imbalance shaft, the first imbalance shaft half and the second imbalance shaft half.

By virtue of the second imbalance shaft being split into the first and second imbalance shaft halves, which are in each case rotatable relative to one another, it is possible for the imbalance masses arranged on the second imbalance shaft to be formed directly on or fastened directly to the second imbalance shaft. The relative rotatability of the two imbalance masses arranged on the second imbalance shaft with respect to one another is achieved by way of the relative rotatability of the imbalance shaft halves with respect to one another.

By contrast to the prior art, it is consequently not necessary for the imbalance masses arranged on the second imbalance shaft to be arranged so as to be relatively rotatable with respect to the second imbalance shaft. In the prior art, this is achieved for example by virtue of the imbalance masses being arranged on adjustment sleeves which are rotatable relative to the imbalance shaft.

By means of the splitting of the second imbalance shaft, a robust and inexpensive design of the second imbalance shaft is consequently realized.

The first imbalance shaft and the second imbalance shaft may be arranged within a housing, wherein the housing is coupled to a ground contact plate of the ground compaction device or vibration plate. The drive device, for example an electric motor or combustion engine, may be arranged on and/or in the housing and be coupled to the driven imbalance shaft, for example by means of a shaft and/or a belt apparatus. The electric motor or combustion engine may be situated on the upper structure, for example not directly on the housing (exciter housing). Power may be transmitted by way of a belt or hydraulically. The drive device may for example be coupled to the first, non-split imbalance shaft.

Owing to the positively locking coupling for opposite rotation, the drive device can set the first and second imbalance shafts, and the imbalance masses formed thereon, in opposing rotational motion. In this way, a working movement of the ground contact plate can be generated by way of a resultant force vector of the centrifugal forces acting on the imbalance masses. By means of a relative rotation of the imbalance masses arranged on the second imbalance shaft with respect to the imbalance mass arranged on the first imbalance shaft, the phase angle of said imbalance masses relative to the imbalance mass arranged on the first imbalance shaft is varied such that the resultant force vector causes a forward or reverse movement and a vibratory movement when at a standstill.

Owing to the split design of the second imbalance shaft with the first imbalance shaft half and the second imbalance shaft half which is arranged coaxially with respect to the first imbalance shaft half and which is relatively rotatable with respect to the first imbalance shaft half, it is possible to realize individual relative rotation of the imbalance masses arranged on the first and second imbalance shaft halves with respect to one another. During the opposite rotation of the two imbalance shafts that can be generated by way of the drive device, it is possible to generate, in accordance with the resultant force vector of the centrifugal forces acting on the imbalance masses, a yaw moment which permits a rotation of the ground compaction device about its vertical axis (which is substantially perpendicular to the surface of the ground), and thus also steering of the working movement.

Since the two imbalance shaft halves are rotatable relative to one another, the respective imbalance masses may be formed or fastened directly on the respective imbalance shaft halves. Consequently, each imbalance shaft half bears a mass fastened thereto. It is therefore not necessary for the imbalance masses of the second imbalance shaft to be arranged so as to be individually relatively rotatable for example by way of an adjustable sleeve. This permits an inexpensive and at the same time robust design of the second imbalance shaft.

In one embodiment, the vibration exciter has a coupling device for coupling the first imbalance shaft half and the second imbalance shaft half in positively locking fashion and so as to be rotatable relative to one another.

The coupling device permits positively locking coupling of the two imbalance shaft halves and thus common rotational behavior of the two imbalance shaft halves as a second imbalance shaft. The relative rotatability of the coupling makes it possible for the imbalance masses formed on the two imbalance shaft halves to be rotated individually and relative to one another about the axis of rotation, and thus set in rotation with a shifted phase angle with respect to one another, which permits the generation of the yaw moment and thus the steering of the ground compaction device during working operation.

In a further embodiment, the vibration exciter has a relative-rotation device for rotating the first imbalance shaft half relative to the second imbalance shaft half and/or relative to the coupling device.

The relative-rotation device makes it possible for the first imbalance shaft half and the imbalance mass arranged thereon to be relatively rotated individually and with respect to the second imbalance shaft half and/or with respect to the coupling device. The relative rotation may be performed for example in response to an operator command while the ground compaction device is at a standstill and/or during the working operation of the ground compaction device. This makes it possible for the operator to control the yaw moment and thus the movement direction of the ground compaction device, and therefore to steer the ground compaction device, for example by actuating an operation device of the ground compaction device or by actuating an operation device on a remote controller of the ground compaction device.

Furthermore, in addition to the relative-rotation device for the first imbalance shaft half, there may correspondingly also be arranged on the vibration exciter a further relative-rotation device for rotating the second imbalance shaft half relative to the first imbalance shaft half and/or relative to the coupling device. This mirror-symmetrical design of the vibration exciter or of the ground compaction device, for example, permits balanced, bilateral steering and traveling behavior.

In a further embodiment, the first imbalance shaft and the second imbalance shaft can be coupled to one another by way of the coupling device in positively locking fashion and for rotatability in opposite directions.

In this embodiment, the coupling device can couple the first imbalance shaft, the first imbalance shaft half and the second imbalance shaft half to one another in positively locking fashion in each case. The coupling device thus couples firstly the first and second imbalance shaft halves, which owing to this coupling form the second imbalance shaft. The second imbalance shaft can likewise be coupled by means of the coupling device to the first imbalance shaft in positively locking fashion and for rotatability in opposite directions. Consequently, the coupling device couples the shafts or shaft halves, which bear the imbalance masses, in positively locking fashion, and thus ensures uniform traveling behavior in accordance with an operator demand.

In a variant of this embodiment, the coupling device may have a sleeve device for receiving at least a part of the first imbalance shaft half and/or of the second imbalance shaft half.

The sleeve device facilitates the positively locking coupling of the first and second imbalance shaft halves to the coupling device for example by way of the respective imbalance shaft half being inserted axially into the sleeve device, such that the sleeve extends in each case over a shaft end of the first and second imbalance shaft halves. It also facilitates the coaxial arrangement with, for example, imbalance shaft halves situated oppositely at the face sides.

Furthermore, substantially cylindrical recesses of the sleeve device, for example, permit the relative rotatability of the imbalance shaft halves with respect to the coupling device and/or with respect to one another.

In a further variant of this embodiment, the sleeve device has, on its outer side, a gearwheel device for engaging into a further gearwheel device which is coupled to the first imbalance shaft.

In this embodiment, the coupling device, for example in the form of a sleeve into both sides of which the respective imbalance shaft half can be coupled in positively locking fashion but so as to be rotatable relative to the sleeve, may be formed with an encircling gearwheel affixed to the sleeve. The two gearwheel devices may for example engage directly into one another in meshing fashion and thus ensure the positively locking coupling of the two imbalance shafts for rotatability in opposite directions.

In a further embodiment, the relative-rotation device has an engagement element, which is arranged on the first imbalance shaft half and which can be displaced axially with respect to the first imbalance shaft half by means of a control slide and which serves for engaging in positively locking fashion into a recess of the first imbalance shaft half and for engaging in positively locking fashion into a recess of the coupling device and/or the sleeve device. At least one of the recesses in this case has a groove which is helical at least in sections. The control slide can be displaced by an actuation device, for example a piston/cylinder unit and/or a mechanical or electromechanical adjustment means.

The further relative-rotation device, which is arranged on the second imbalance shaft half, may also be of such a configuration, and thus ensure the relative rotatability of the second imbalance shaft half with respect to the coupling device.

In this embodiment, the engagement element produces the positively locking coupling between the first imbalance shaft half and the coupling device. Said engagement element can be displaced by the control slide and, in the process, can perform a movement with at least a movement component directed axially along the axis of rotation of the first imbalance shaft half. Said engagement element, at one side, engages in positively locking fashion into a recess of the first imbalance shaft half, for example into a groove in the first imbalance shaft half, which is in the form of a hollow shaft. At the other side, the engagement element engages in positively locking fashion into a recess of the coupling device and/or of the sleeve device, for example into a groove formed into the sleeve device. Owing to the helical profile, at least in sections, of at least one of the recesses or grooves, it is the case during a displacement of the engagement element that the first imbalance shaft half rotates relative to the coupling device or sleeve device. When the control slide is at a standstill relative to the first imbalance shaft half, the engagement element remains in engagement both with the first imbalance shaft half and with the sleeve device, and thus produces the positively locking coupling which ensures the common rotation of imbalance shaft half and coupling device.

In a further variant of this embodiment, the first imbalance shaft half has a cavity. The control slide and the actuation device and/or the piston/cylinder unit are arranged within the cavity.

Correspondingly, the second imbalance shaft half may also have a cavity in which corresponding parts of the further relative-rotation device may be arranged.

For example, the first (and/or second) imbalance shaft half may be at least partially in the form of a hollow shaft, in which the relative-rotation device or parts of the relative-rotation device, such as for example the control slide, the actuation device and/or the piston/cylinder unit, may be arranged. Parts of the relative-rotation device such as for example the actuation device, the piston/cylinder unit and/or the control slide can in this case be rotationally decoupled from a rotation of the respective imbalance shaft half for example by means of a rotation decoupling device, and thus arranged rotationally conjointly with respect to the housing. The rotation decoupling device may have a bearing device such as, for example, a ball bearing.

Such an arrangement of at least parts of the relative-rotation device within the second imbalance shaft makes it possible for structural space to be saved in particular in a region to the sides of the second imbalance shaft, and thus for the ground compaction device to be of narrow design.

In a further embodiment, an orbit of the imbalance mass formed on the first imbalance shaft half about the first imbalance shaft half at least partially surrounds the cavity, the actuation device, a piston of the piston/cylinder unit and/or a cylinder of the piston/cylinder unit.

For example, it is possible for the imbalance mass formed on the first imbalance shaft half to be arranged at the outside on the first imbalance shaft half, at a side of the first imbalance shaft half facing away from the coupling device, for example at as great a distance as possible from a central plane or plane of symmetry, which is perpendicular to the ground contact plate, of the ground compaction device. In this way, a large lever arm of the centrifugal force vector generated by the rotation of the imbalance mass is attained, whereby a particularly high rate of rotation or yaw rate about the vertical axis of the ground compaction device can be attained.

In particular, the imbalance mass formed on the first imbalance shaft half can, in the case of such an embodiment, be arranged far to the outside on the housing, as no separate structural space needs to be provided laterally adjacent to the second imbalance shaft for the arrangement of the relative-rotation device, which is for example received entirely in the respective imbalance shaft halves. Consequently, the second imbalance shaft can be of broad design, which as described above leads to a large lever arm of the centrifugal force vectors and thus to a high rate of rotation. Furthermore, the housing can be designed to be compact and only insignificantly broader than the second imbalance shaft half.

In a further embodiment, a bearing device which surrounds the first imbalance shaft half and which serves for the mounting of the first imbalance shaft half in the housing is arranged axially between the imbalance mass arranged on the first imbalance shaft half and the coupling device and/or the sleeve device. Alternatively or in addition, at that side of the imbalance mass arranged on the first imbalance shaft half which faces away from the coupling device and/or the sleeve device, there is arranged a further bearing device which surrounds the first imbalance shaft half and which serves for the mounting of the first imbalance shaft half in the housing.

Further bearing devices may correspondingly also be arranged on the second imbalance shaft half.

Owing to the arrangement of the bearing device axially between the imbalance mass and the coupling device or the sleeve device, and the arrangement of the further bearing device at that side of the imbalance mass which faces away from the coupling device, elastic axial deformations introduced into the first imbalance shaft half by the rotating imbalance mass are lessened and are substantially isolated from the coupling device. Bending of the second imbalance shaft is prevented. Consequently, the first gearwheel device, which is arranged on the coupling device, is subjected to vibrations of significantly lower intensity and a smaller axial offset, such that the positively locking coupling of the imbalance shafts at the gearwheel pairing is relieved of load. The gearwheel pairing provided for the coupling of the two imbalance shafts consequently runs more quietly, and a longer service life is facilitated.

BRIEF DESCRIPTION OF THE DRAWING

These and further features of the invention will be discussed in more detail below on the basis of an example and with reference to the appended FIGURE, in which:

FIG. 1 shows a section of a vibration exciter according to the invention in a plan view.

DETAILED DESCRIPTION

The FIGURE schematically shows an embodiment of a vibration exciter 1 in a view from above in a section in a plane running substantially parallel to the surface of the ground to be processed. The vibration exciter 1 may be used in particular in a vibratory plate foreground compaction.

The vibration exciter 1 has a first imbalance shaft 3 which is driven in rotation by a drive device 2 and which has imbalance masses 4*a* and 4*b* arranged or fastened thereon. By means of two gearwheels 5 and 6, the rotational movement of the first imbalance shaft 3 is transmitted in positively locking fashion to a second imbalance shaft 7 such that the latter rotates in the opposite direction.

The second imbalance shaft 7 has a first imbalance shaft half 8*a* and a second imbalance shaft half 8*b* which is arranged coaxially with respect to the first imbalance shaft half 8*a* and which is rotatable relative to the first imbalance shaft half. The two imbalance shaft halves 8*a* and 8*b* are inserted into both sides of an adjustment sleeve 9 which belongs to a coupling device and which couples the two imbalance shaft halves 8*a* and 8*b* in positively locking fashion but such that they are rotatable relative to one another. The gearwheel 6 is arranged in encircling fashion on the adjustment sleeve 9. The adjustment sleeve 9 consequently forms, with the gearwheel 6, a coupling device for the positively locking coupling of the first imbalance shaft 3 to the second imbalance shaft 7, which is composed of the two imbalance shaft halves 8*a*, 8*b*.

Adjustable imbalances 10*a* and 10*b* are arranged or fastened on the two imbalance shaft halves 8*a* and 8*b*. To realize an individual relative rotation of the adjustable imbalances 10*a*, 10*b* about the axis of rotation of the second imbalance shaft 7, respective relative-rotation devices 11*a*, 11*b* are provided and are recessed into the imbalance shaft halves 8*a* and 8*b*, which are in the form of hollow shafts.

By means of the relative-rotation devices 11*a*, 11*b*, the phase angle of the adjustable imbalances 10*a*, 10*b* relative to the imbalance masses 4*a*, 4*b* arranged on the first imbalance shaft 3 can be adjusted. By means of the centrifugal force vectors that act on the imbalance masses 4*a*, 4*b*, 10*a*, 10*b* during a rotation of the imbalance masses 4*a*, 4*b* and 10*a*, 10*b* in each case about the oppositely rotating imbalance shafts 3, 7, it is possible, with a shifted phase angle, to realize a forward or reverse movement of the ground compaction device that is operated by way of the vibration exciter 1. By means of a relative rotation of the adjustable imbalances 10*a*, 10*b* with respect to one another, a yaw moment and thus a rotation of the ground compaction device is generated about a vertical axis of the vibration exciter 1 or of the ground compaction device, said vertical axis projecting vertically out of the plane of the drawing.

Below, only the relative-rotation device 11*a* will be discussed. The relative-rotation device 11*b* is of identical construction and, in the FIGURE, is illustrated mirror-symmetrically with respect to the relative-rotation device 11*a*.

The relative-rotation device 11*a* has, as actuation device, a piston 12*a* arranged in a cover sleeve, the latter being arranged or fastened on a housing 19 of the vibration exciter 1 and engaging into the imbalance shaft half 8*a*. Part of the cover sleeve is formed by a cylinder 22*a* in which the piston 12*a* is mounted in axially movable fashion. The cover sleeve, the cylinder 22*a* and the piston 12*a* are rotationally decoupled from the imbalance shaft half 8*a* by way of bearing 18*a* and are fastened to the housing 19 of the vibration exciter 1.

The piston 12*a* can axially displace a slide 13*a* within the imbalance shaft half 8*a*. The slide 13*a* bears a transverse pin 14*a* which extends through a helical groove 15*a* provided in a wall of the first imbalance shaft half 8*a*, which is in the form of a hollow shaft. At the same time, the transverse pin 14*a* engages into a longitudinal groove 16 which is formed on the inner side of the adjustment sleeve 9 and which lies radially outside or above the helical groove 15*a*. Owing to the helical profile of the groove 15*a*, the axial displacement of the slide 13*a* with the transverse pin 14*a* has the effect of forcibly imparting to the first imbalance shaft half 8*a* a rotational movement relative to the adjustment sleeve 9. In this way, the relative rotational position of the adjustable imbalance 10*a* relative to the adjustment sleeve 9, relative to the adjustable imbalance 10*b* and relative to the first imbalance shaft 3 is varied.

The helical groove 15*a* forms a recess of the first imbalance shaft half 8*a* and is preferably arranged in a region of the first imbalance shaft half 8*a* which faces toward the central axis of symmetry of the housing 19 (exciter housing) and/or of the ground compaction device. The recess is preferably arranged in a half of the first imbalance shaft half 8*a*, and/or the recess extends over at most a half of the length of the first imbalance shaft half 8*a*, which half faces toward the central axis of symmetry. The recess is particularly preferably arranged in a third of the first imbalance shaft half 8*a*, and/or the recess extends over at most a third of the length of the first imbalance shaft half 8*a*, which third faces toward the central axis of symmetry.

During working operation, the adjustable imbalances 10*a* and 10*b* seek, owing to their inertia, to change their respective phase angle in a retarding direction, and thus push the pistons 12*a* and 12*b* back into their initial positions. To further assist the return movement of the pistons 12*a*, 12*b*, spring devices may be provided, and arranged for example within the cylinders 22*a*, 22*b*. The spring devices can support the pistons 12*a*, 12*b* for example against a face side, facing toward the adjustment sleeve 9, of the respective cylinder 22*a*, 22*b*.

In this arrangement, the relative-rotation device 11*a* is almost entirely recessed into a cavity of the first imbalance shaft half 8*a*. Only an inlet 17*a* for hydraulic fluid for the movement or exertion of pressure on the piston 12*a* projects out of the first imbalance shaft half 8*a*. The piston 12*a*, at least in a maximally retracted position, is entirely received in the second imbalance shaft 7 and/or recessed into the first imbalance shaft half 8*a*. The piston 12*a*, the cylinder 22*a* and the inlet 17*a* are in this case decoupled from a rotational movement of the first imbalance shaft half 8*a* and of the slide 13*a* by way of a bearing 18*a*, which serves as a rotational decoupling means.

Furthermore, it may be the case that the end region of the piston 12*a*, even in a maximally deployed position, that is to say remote from the central axis of symmetry of the housing 19, is received entirely in the second imbalance shaft 7 and/or does not project out of the contour formed by the housing 19 (exciter housing). The exciter housing is to be understood to mean the housing 19 without further fixtures, which housing serves for receiving the shafts 3, 7 and imbalance masses 4*a*, 4*b*, 10*a*, 10*b*.

In this arrangement, an orbit of the adjustable imbalance 10*a* about the first imbalance shaft half 8*a* may at least partially or even entirely surround the cavity, the piston 12*a* and/or the cylinder 22*a*. This makes it possible for the adjustable imbalance 10*a* to be arranged far to the outside on the first imbalance shaft half 8*a*, that is to say with a large spacing to an axis of symmetry, running through the gearwheels 5, 6, of the vibration exciter 1, and for example directly adjacent to a housing 19 of the vibration exciter 1. Consequently, during the rotation of the adjustable imbalance 10*a*, a large lever arm acts, which can yield a high rate of rotation of the ground compaction device about the vertical axis.

Good controllability of the ground compaction device can be attained in particular if, as shown in the FIGURE, the second and third imbalance masses 10*a*, 10*b* (adjustable imbalances 10*a*, 10*b*) are arranged far remote from the center of the exciter. In this way, it can be achieved that the imbalance masses 4*a*, 4*b* and the second and third imbalance masses 10*a*, 10*b* (adjustable imbalances 10*a*, 10*b*) are arranged axially offset with respect to one another such that there is only a small overlap, or no overlap, between the imbalance masses 4*a*, 4*b*, 10*a*, 10*b*. The overlap between an imbalance mass 4*a*, 4*b* of the first imbalance shaft 3 and an imbalance mass 10*a*, 10*b* (adjustable imbalance 10*a*, 10*b*) of the second imbalance shaft 7 is preferably at most 50 percent. To calculate this, the axial length of the overlap is set in a ratio with respect to the added-together total length of the two imbalance masses. The overlap is more preferably at most 25 percent. There is particularly preferably no overlap between the imbalance masses 4*a*, 4*b*, 10*a*, 10*b*.

An inner bearing 20*a* is arranged axially between the adjustable imbalance 10*a* and the adjustment sleeve 9, and a further inner bearing 20*b* is arranged between the adjustable imbalance 10*b* and the adjustment sleeve 9. The adjustment sleeve 9 with the gearwheel 6 is thus mounted between the adjacently arranged inner bearings 20*a* and 20*b*. Furthermore, the second imbalance shaft 7 is mounted on the housing 19 by way of outer bearings 21*a*, 21*b*. The outer bearings 21*a*, 21*b* may be arranged adjacent to or in the direct vicinity of the adjustable imbalances 10*a*, 10*b*. The adjustment sleeve 9 is positioned on, and supported by, the end regions of the first imbalance shaft half 8*a* and of the second imbalance shaft half 8*b*.

Thus, the first imbalance shaft half 8*a* is mounted in the housing 19 by way of the bearings 20*a* and 21*a*, whereas the second imbalance shaft half 8*b* is mounted in the housing 19 by way of the bearings 20*b* and 21*b*.

Elastic deformations of the second imbalance shaft 7, which are imparted to the latter by the rotating adjustable imbalances 10*a* and 10*b*, are lessened by the bearings 20*a*, 20*b* and 21*a*, 21*b*. The adjustment sleeve 9 with the gearwheel 6 arranged thereon is thus subjected to elastic displacement only to a small extent. Consequently, the gearwheel pairing 5, 6 runs relatively quietly, and is subjected to significantly lower mechanical load. Furthermore, the bearings 20*a*, 20*b*, 21 *a*, 21*b* are arranged, with regard to the first and second imbalance shaft halves 8*a*, 8*b*, such that the loads imparted by the second and third imbalance masses 10*a*, 10*b* (adjustable imbalances 10*a*, 10*b*) are dissipated by the respectively adjacently arranged bearings, such that the region of the respective imbalance shaft half 8*a*, 8*b* in which the recess (helical groove 15*a*, 15*b*) is arranged is isolated from the load.

Owing to the splitting of the second imbalance shaft 7 into the two imbalance shaft halves 8*a* and 8*b*, it is possible in the embodiment shown in the FIGURE for the adjustable imbalances 10*a* and 10*b* to be arranged directly on the imbalance shaft halves 8*a* and 8*b*. The adjustment sleeve 9 is thus not subjected to load by the imbalances, but is spatially separate from the second and third imbalance masses 10*a*, 10*b* (adjustable imbalances 10*a*, 10*b*). Furthermore, in each case one bearing point is arranged between the adjustment sleeve 9 and the second and third imbalance masses 10*a*, 10*b* (adjustable imbalances 10*a*, 10*b*), such that the action of the imbalance masses (adjustable imbalances 10*a*, 10*b*) on the sleeve (adjustment sleeve 9), and on the adjustment arrangement 9, 13*a*, 13*b*, 14*a*, 14*b*, 15*a*, 15*b* as a whole, is minimized. This increases the robustness of the vibration exciter 1. In the exemplary embodiment shown, the torque flow runs from the drive device 2 via the first imbalance shaft 3, the gearwheel pairing 5, 6, the adjustment sleeve 9, the engagement elements (transverse pins) 14*a*, 14*b*, in each case to the first and second imbalance shaft halves 8*a*, 8*b* and in each case onward to the second and third imbalance masses 10*a*, 10*b* (adjustable imbalances 10*a*, 10*b*).

The relative rotatability of the adjustable imbalances 10*a* and 10*b* is in this case ensured by way of the centrally arranged adjustment sleeve 9. The adjustment sleeve 9 is in this case isolated from the weight of the adjustable imbalances 10*a* and 10*b* and is furthermore protected, by the inner bearings 20*a* and 20*b*, from the shaft bending caused by the rotating adjustable imbalances 10*a*, 10*b*. Consequently, quieter operation and an increased service life of the vibration exciter 1 can be expected.

Owing to the arrangement of the relative-rotation devices 11*a*, 11*b* within the imbalance shaft halves 8*a*, 8*b* formed as hollow shafts, the adjustable imbalances 10*a* and 10*b* can be arranged far to the outside on the second imbalance shaft 7 and thus with a large lever arm with respect to the vertical axis of the ground compaction device. This permits a high level of rotational dynamics and improved traveling behavior of the ground compaction device or vibratory plate in accordance with an operator demand. Traveling maneuvers can be realized more quickly, leading to greater productivity of the ground compaction device. This also applies in particular to remote-controlled vibratory plates of compact design.

The invention claimed is:

1. A vibration exciter for a ground compaction device, comprising:

a first imbalance shaft, a second imbalance shaft which is arranged axially parallel to the first imbalance shaft and which is coupled to the first imbalance shaft in a positively locking fashion so as to rotate in the opposite direction as the first imbalance shaft, wherein the second imbalance shaft is formed from a first imbalance shaft half and a second imbalance shaft half which is arranged coaxially with respect to the first imbalance shaft half and which is rotatable relative to the first imbalance shaft half, a drive device which is configured to drive one of the imbalance shafts in rotation, and a coupling device which couples the first imbalance shaft half and the second imbalance shaft half together in a positively locking fashion and so as to be rotatable relative to one another, the coupling device comprising a sleeve having opposed ends into which the first and second imbalance shaft halves and first and second traverse pins are inserted, wherein each of the first and second transverse pins engages the sleeve and a respective one of the first and second imbalance shaft halves; wherein at least one imbalance mass is arranged on each of the first imbalance shaft, the first imbalance shaft half, and the second imbalance shaft half.

2. The vibration exciter as claimed in claim 1, further comprising a relative-rotation device which is configured to rotate the first imbalance shaft half relative to at least one of the second imbalance shaft half and the coupling device.

3. The vibration exciter as claimed in claim 1, wherein the first imbalance shaft and the second imbalance shaft are coupled to one another by way of the coupling device so as to rotate in opposite directions.

4. The vibration exciter as claimed in claim 1, wherein the sleeve device has, on an outer side thereof, a gearwheel device that is configured to engage into a further gearwheel device which is coupled to the first imbalance shaft.

5. The vibration exciter as claimed in claim 2, wherein the relative-rotation device comprises the first transverse pin which is arranged on the first imbalance shaft half, which can be displaced axially with respect to the first imbalance shaft half by a control slide, and which is configured to engage in a positively locking fashion into 1) a recess of the first imbalance shaft half and 2) a recess of at least one of the coupling device and the sleeve device, wherein at least one of the recesses has a groove which runs helically at least in sections thereof, and wherein the control slide is configured to be displaced by way of at least one of an actuation device and a piston/cylinder unit.

6. The vibration exciter as claimed in claim 5, wherein the first imbalance shaft half has a cavity, and the control slide and the actuation device are arranged within the cavity.

7. The vibration exciter as claimed in claim 1, wherein a further relative-rotation device is provided that comprises the second transverse pin which is arranged on the second imbalance shaft half, which can be displaced axially with respect to the second imbalance shaft half by a further control slide, and which is configured to engage in a positively locking fashion into 1) a further recess of the second imbalance shaft half and 2) a further recess in at least one of the coupling device and the sleeve device, wherein at least one of the further recesses has a groove which runs helically at least in sections thereof, and wherein the further control slide is configured to be displaced by way of a further piston/cylinder unit.

8. The vibration exciter as claimed in claim 7, wherein the second imbalance shaft half has a further cavity, and the further control slide and the further actuation device are arranged within the further cavity.

9. The vibration exciter as claimed in claim 5, wherein an orbit of the imbalance mass on the first imbalance shaft half about the first imbalance shaft half at least partially surrounds at least one of the cavity, the actuation device, a piston of the piston/cylinder unit, and a cylinder of the piston/cylinder unit.

10. The vibration exciter as claimed in claim 1, wherein a bearing device surrounds the first imbalance shaft half and is arranged axially between the imbalance mass on the first imbalance shaft half and the coupling device, and at a side of the imbalance mass arranged on the first imbalance shaft half which, faces away from the coupling device, there is arranged a further bearing device which surrounds the first imbalance shaft half.

* * * * *